US011306692B2

(12) United States Patent
Shomura et al.

(10) Patent No.: US 11,306,692 B2
(45) Date of Patent: Apr. 19, 2022

(54) OUTBOARD ENGINE

(71) Applicant: SUZUKI MOTOR CORPORATION, Hamamatsu (JP)

(72) Inventors: Nobuyuki Shomura, Hamamatsu (JP); Akinori Yamazaki, Hamamatsu (JP); Sho Ishizaki, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 17/091,142

(22) Filed: Nov. 6, 2020

(65) Prior Publication Data

US 2021/0140396 A1 May 13, 2021

(30) Foreign Application Priority Data

Nov. 11, 2019 (JP) ..... JP2019-203739

(51) Int. Cl.
*F02M 35/16* (2006.01)

(52) U.S. Cl.
CPC ..... *F02M 35/168* (2013.01)

(58) Field of Classification Search
CPC ..... F02M 35/168
See application file for complete search history.

(56) References Cited

U.S. PATENT DOCUMENTS 5,904,604 A * 5/1999 Suzuki ..... B63J 3/02 440/84
6,045,421 A * 4/2000 Hiraoka ..... F01P 1/06 440/77
6,964,255 B2 * 11/2005 Shomura ..... F01P 3/202 123/198 E
7,267,591 B2 * 9/2007 Kimura ..... B63H 20/32 440/77
7,425,163 B2 * 9/2008 Murai ..... F02M 35/168 440/77
7,488,227 B2 * 2/2009 Fujima ..... F02M 37/24 440/77
9,587,601 B1 * 3/2017 Ochiai ..... F02B 75/007
9,643,702 B2 * 5/2017 Shomura ..... F02M 35/1211
2004/0149241 A1 * 8/2004 Shomura ..... F02B 61/045 123/41.7

FOREIGN PATENT DOCUMENTS

JP 10024898 A * 1/1998
JP H10024898 A 1/1998

* cited by examiner

*Primary Examiner* — S. Joseph Morano
*Assistant Examiner* — Jovon E Hayes
(74) *Attorney, Agent, or Firm* — Holtz, Holtz & Volek PC

(57) ABSTRACT

In an outboard engine including a throttle body that feeds combustion air that is taken in from an outside air introduction port, into an engine body, an intake duct that guides the combustion air from the outside air introduction port, and an on-off valve disposed partway in the intake duct, a plurality of paths are provided in the intake duct, a path of the intake duct is made switchable to a long path including a drainage effect to water entering the intake duct and a short path that does not include the drainage effect by the on-off valve, and the long path is selected at a time of an engine being stopped or a time of an operation state where the outboard engine is expected to be covered with water.

5 Claims, 9 Drawing Sheets

FIG. 7

700

| NO | SWITCHING CONDITION | FIRST INTAKE PASSAGE (LONG PATH) | SECOND INTAKE PASSAGE (SHORT PATH)) |
|---|---|---|---|
| 1 | ENGINE STOP | ○ | |
| 2 | SHIFT NEUTRAL (N) | ○ | |
| 3 | SHIFT REVERSE (R) | ○ | |
| 4 | SHIFT FORWARD (F) | △ | ○ |
| 5 | THROTTLE OPENING DEGREE (SPECIFIED VALUE OR MORE) | △ | ○ |
| 6 | THROTTLE OPENING DEGREE (LESS THAN SPECIFIED VALUE) | ○ | |
| 7 | ENGINE SPEED (LESS THAN SPECIFIED VALUE) | ○ | |
| 8 | INTERNAL TEMPERATURE SPECIFIED VALUE OR MORE | ○ | |
| 9 | VENTILATION UNIT TEMPERATURE SPECIFIED VALUE OR MORE | ○ | |
| 10 | ELECTRICAL COMPONENT TEMPERATURE SPECIFIED VALUE OR MORE | ○ | |
| 11 | WATER DROP DETECTION(PRESENT) | ○ | |
| 12 | SWITCH SELECTION (LONG PATH) | ○ | △ |
| 13 | SWITCH SELECTION (SHORT PATH) | △ | ○ |

FIG. 8

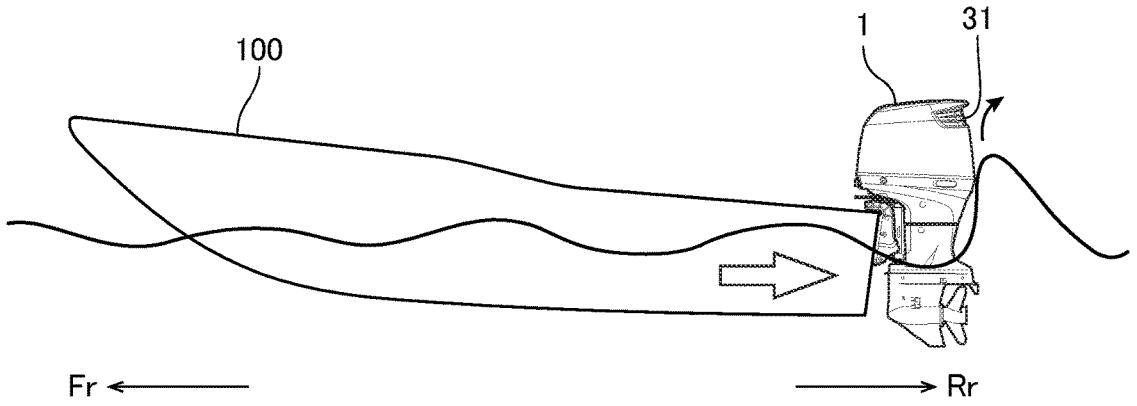

OUTBOARD ENGINE

CROSS-REFERENCE TO RELATED APPLICATION

This application is based upon and claims the benefit of priority of the prior Japanese Patent Application No. 2019-203739, filed on Nov. 11, 2019, the entire contents of which are incorporated herein by reference.

BACKGROUND OF THE INVENTION

Field of the Invention

The present invention relates to an outboard engine.

Description of the Related Art

Conventionally, there has been proposed an outboard engine that enhances combustion stability during a low-load low-speed operation by promoting vaporization of fuel (see Japanese Patent Laid-Open No. 10-24898). In the outboard engine, in an intake duct that has a first intake port and a second intake port, an on-off valve that closes when an engine operation range is in a low-load low-speed range is provided at an upstream side of the second intake port. Vaporization is promoted by controlling the temperature of the fuel injected from a fuel injection device by opening and closing the on-off valve and switching the intake passage depending on whether the engine operation range is in the low-load low-speed range or in the high-load high-speed range.

However, in the outboard engine described in Japanese Patent Laid-Open No. 10-24898, the opening and closing state of the on-off valve is switched in response to the engine operation range, and therefore there is a possibility that water enters the inside of the engine through the on-off valve in an open state under the environment where the outboard engine is covered with water. Entry of water into the engine not only causes combustion failure and output reduction of the engine, but also causes a problem that components inside the engine are damaged (damage from heat shock, for example) or corroded.

The present invention is made in view of the above circumstances, and one of objects of the present invention is to provide an outboard engine that can secure performance of an engine and restrain occurrence of malfunction of engine components even under an environment where the outboard engine is covered with water.

SUMMARY OF THE INVENTION

One aspect of an outboard engine of the present invention is an outboard engine including an outside air introduction port that is provided in an engine cover covering an engine body and takes in combustion air, a throttle body that feeds the combustion air that is taken in from the outside air introduction port, into the engine body, an intake air guide portion that guides the combustion air from the outside air introduction port, a switching valve disposed partway in the intake air guide portion, an actuator that drives the switching valve, and a control device that controls movement of the actuator, wherein the actuator is disposed at an upper portion of the engine body, a plurality of paths are provided in the intake air guide portion, and a path of the intake air guide portion is made switchable to a long path including a drainage effect to water entering the intake air guide portion and a short path that does not include the drainage effect by the switching valve, and the long path is selected at a time of an engine of the outboard engine being stopped or a time of an operation state where the outboard engine is expected to be covered with water.

According to the present invention, even under an environment where the outboard engine is covered with water, performance of the engine can be secured and occurrence of malfunction of engine components can be restrained.

BRIEF DESCRIPTION OF THE DRAWINGS

FIG. 7 is an explanatory diagram of a switching condition table of an intake passage in the outboard engine according to the present embodiment;

FIG. 8 is an explanatory view of a water covering state at a time of backward movement of a ship including the outboard engine of the present embodiment;

DETAILED DESCRIPTION OF THE PREFERRED EMBODIMENT

Hereinafter, each embodiment of the present invention will be described in detail with reference to the accompanying drawings. In an outboard engine according to the present embodiment, a first intake passage that has a long flow distance of combustion air and includes a drainage effect, and a second intake passage that has a short flow distance of combustion air and does not include a drainage effect are included, and the intake passage is switched according to whether or not the outboard engine is in an environment where the outboard engine is expected to be covered with water. Specifically, in the environment where the outboard engine is expected to be covered with water, entry of water into the engine is prevented by selecting the first intake passage.

Figure 1:
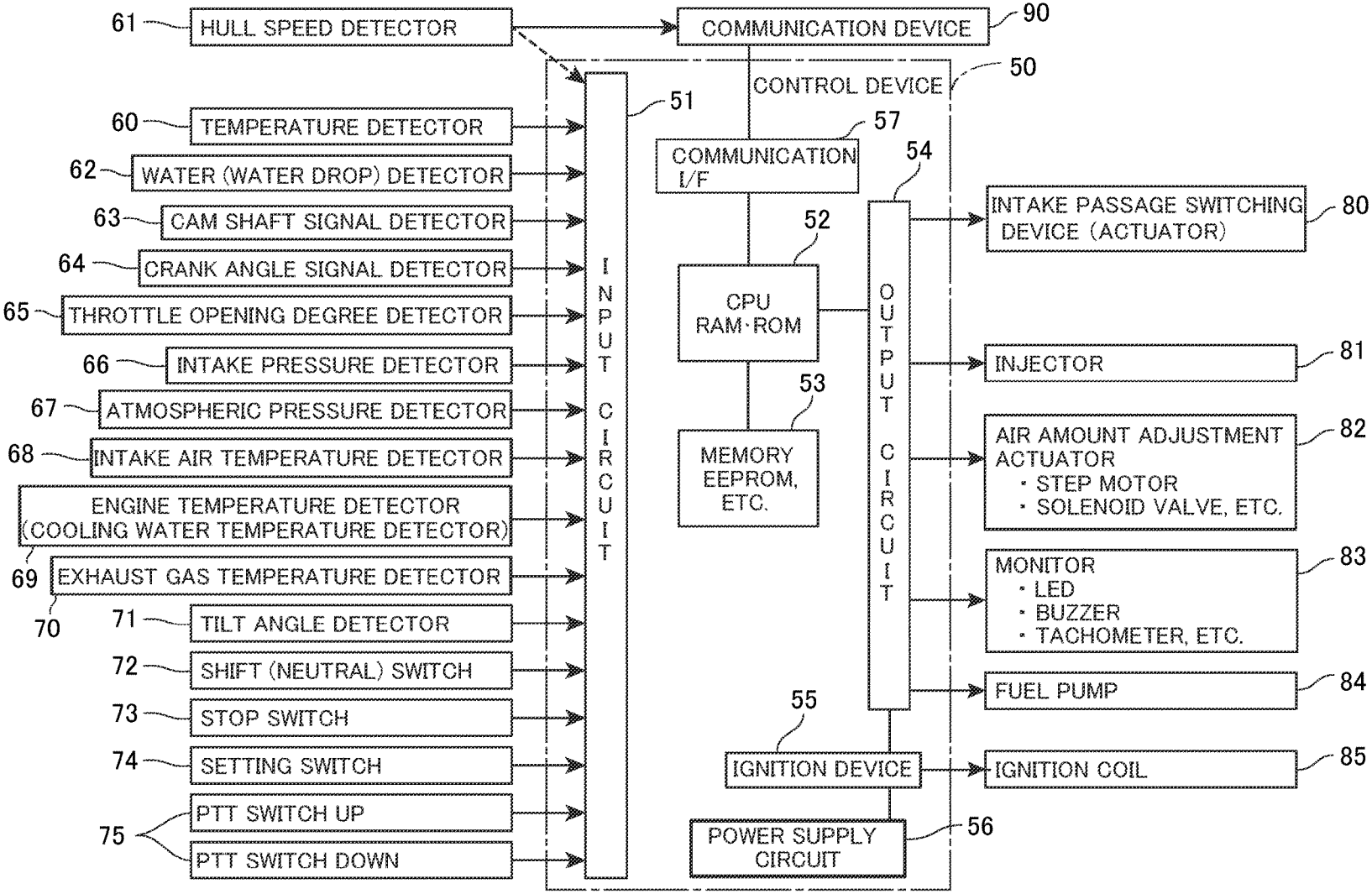
FIG. 1 is a system configuration of an outboard engine according to a present embodiment.

FIG. 1 is a system configuration diagram of an outboard engine 1 according to the present embodiment. As illustrated in FIG. 1, the outboard engine 1 according to the present embodiment includes a control device 50 that performs control of the entire outboard engine 1. For example, the control device 50 is configured by including an input circuit 51, an operation unit 52 configured by a CPU, a RAM and a ROM, a memory 53, an output circuit 54, an ignition device 55, a power supply circuit 56, and a communication interface (IF) 57.

To the control device 50, various kinds of information are inputted from various devices (a detector and a switch) installed inside and outside the outboard engine 1. Specifically, a temperature of an engine of the outboard engine 1, a temperature in an engine room, and a temperature of electrical components in the engine room are inputted to the operation unit 52 from a temperature detector 60 via the input circuit 51. The temperature detector 60 configures an example of a temperature detection unit, and is provided, for example, in an engine body 2 described later.

Likewise, for example, a hull speed measured by a GPS function is inputted to the operation unit 52 from a hull speed detector 61. Further, presence or absence of water entering the engine room from a water detector (water detection sensor) 62 is inputted to the operation unit 52. Note that the hull speed from the hull speed detector 61 may be inputted to a communication device 90 communicable with the control device 50, and may be inputted to the operation unit 52 via the communication I/F 57.

Further, a signal of a cam shaft (cam angle signal) not illustrated of the engine is inputted from a cam shaft signal detector 63 to the operation unit 52 via the input circuit 51. Likewise, an engine speed signal is inputted from a crank angle signal detector 64, a throttle opening degree is inputted from a throttle opening degree detector 65, a throttle opening degree is inputted from a throttle opening degree detector 65, intake pressure and atmospheric pressure are respectively inputted from an intake pressure detector 66 and an atmospheric pressure detector 67 respectively, an intake air temperature is inputted from an intake air temperature detector 68, an engine temperature (cooling water temperature) is inputted from an engine temperature detector 69, and an exhaust gas temperature is inputted from an exhaust gas temperature detector 70 respectively, to the operation unit 52.

Further, a tilt angle signal of the outboard engine 1 is inputted from a tilt angle detector 71 to the operation unit 52. Further, a shift position signal is inputted to the operation unit 52 from a shift (neutral) switch 72 provided at a shift device, for example. Further, a stop signal, setting information, and a PTT control signal are inputted respectively to the operation unit 52 from a stop switch (emergency stop switch) 73, a setting switch 74 and a PTT (power trim tilt) switch 75. For example, an operator determines a situation (water covering situation to the outboard engine 1) at a time of operation using the setting switch 74, and an intake passage of an intake duct 4 described later can be selected manually, as will be described later.

Information from various devices inputted to the control device 50 is properly processed arithmetically in the operation unit 52, and an arithmetic operation result is outputted to the various devices installed inside and outside the outboard engine 1 via the output circuit 54. Specifically, the operation unit 52 outputs a signal (switching signal) for switching the intake passage of the intake duct 4 described later to an intake passage switching device (hereinafter, also referred to as a "switching device") 80. The switching device 80 configures one example of the actuator, and is configured by a drive motor, a solenoid, a diaphragm or the like, for example. The control device 50 controls movement of the switching device 80.

Further, the operation unit 52 outputs fuel injection amount information to an injector 81, outputs an adjustment signal of an intake air amount to a step motor, a solenoid vale or the like of an air amount adjustment actuator 82, outputs an engine speed signal and signals that transmit abnormalities of the respective devices to an LED display of a monitor 83, a buzzer, a tachometer and the like, and outputs fuel supply amount information to a fuel pump 84, respectively. Further, the operation unit 52 outputs an ignition signal to an ignition coil 85 via the ignition device 55 from the output circuit 54.

Figure 2:
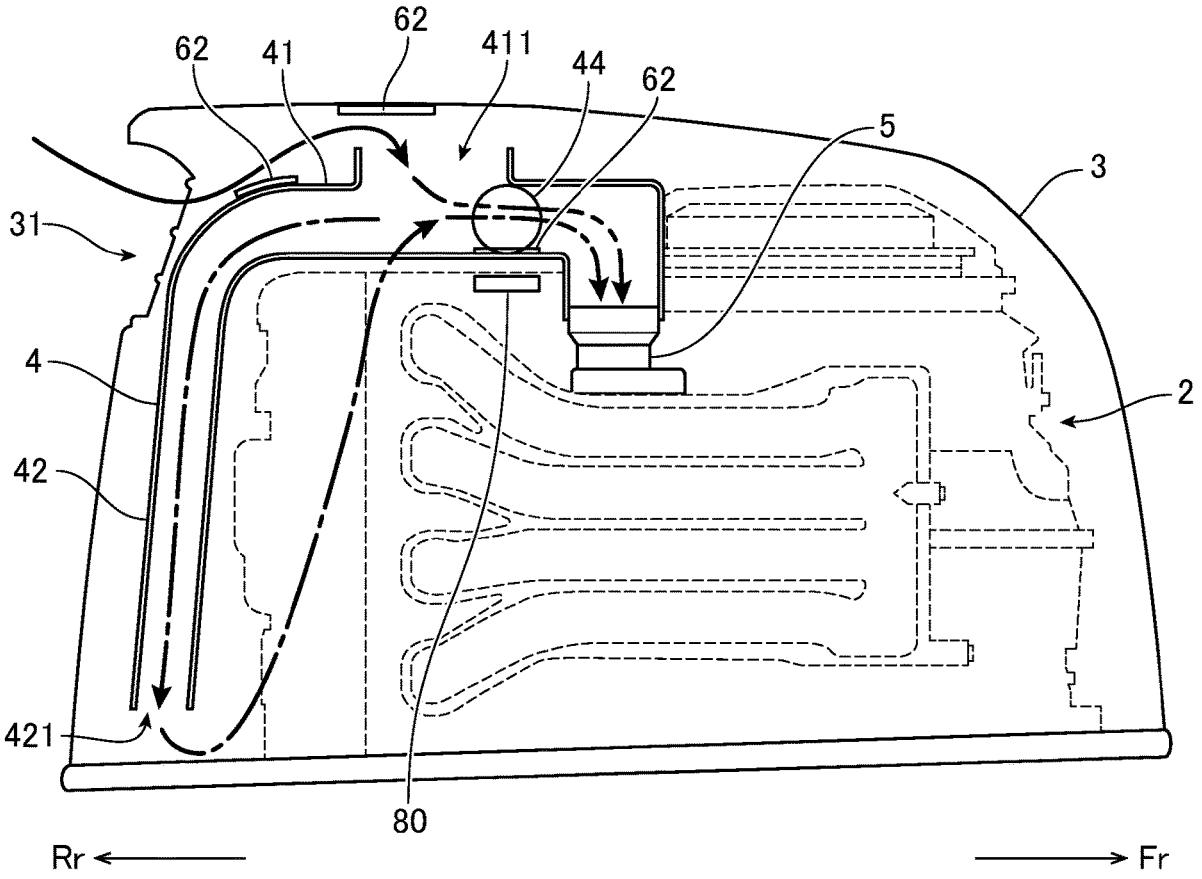
FIG. 2 is an explanatory view of a configuration of an intake duct included by the outboard engine according to the present embodiment.

Having a configuration like this, the outboard engine 1 performs air intake by switching a pair of intake passages (a first and a second intake passages) provided in the outboard engine 1 in response to a predetermined condition. Hereinafter, a configuration of an intake duct having an intake passage of the outboard engine 1 according to the present embodiment will be described with reference to FIG. 2 to FIG. 6. FIG. 2 is an explanatory view of a configuration of an intake duct 4 included by the outboard engine 1 according to the present embodiment. Note that FIG. 2 schematically illustrates only an upper side part of the outboard engine 1 that houses the engine body 2 described later.

Figure 3:
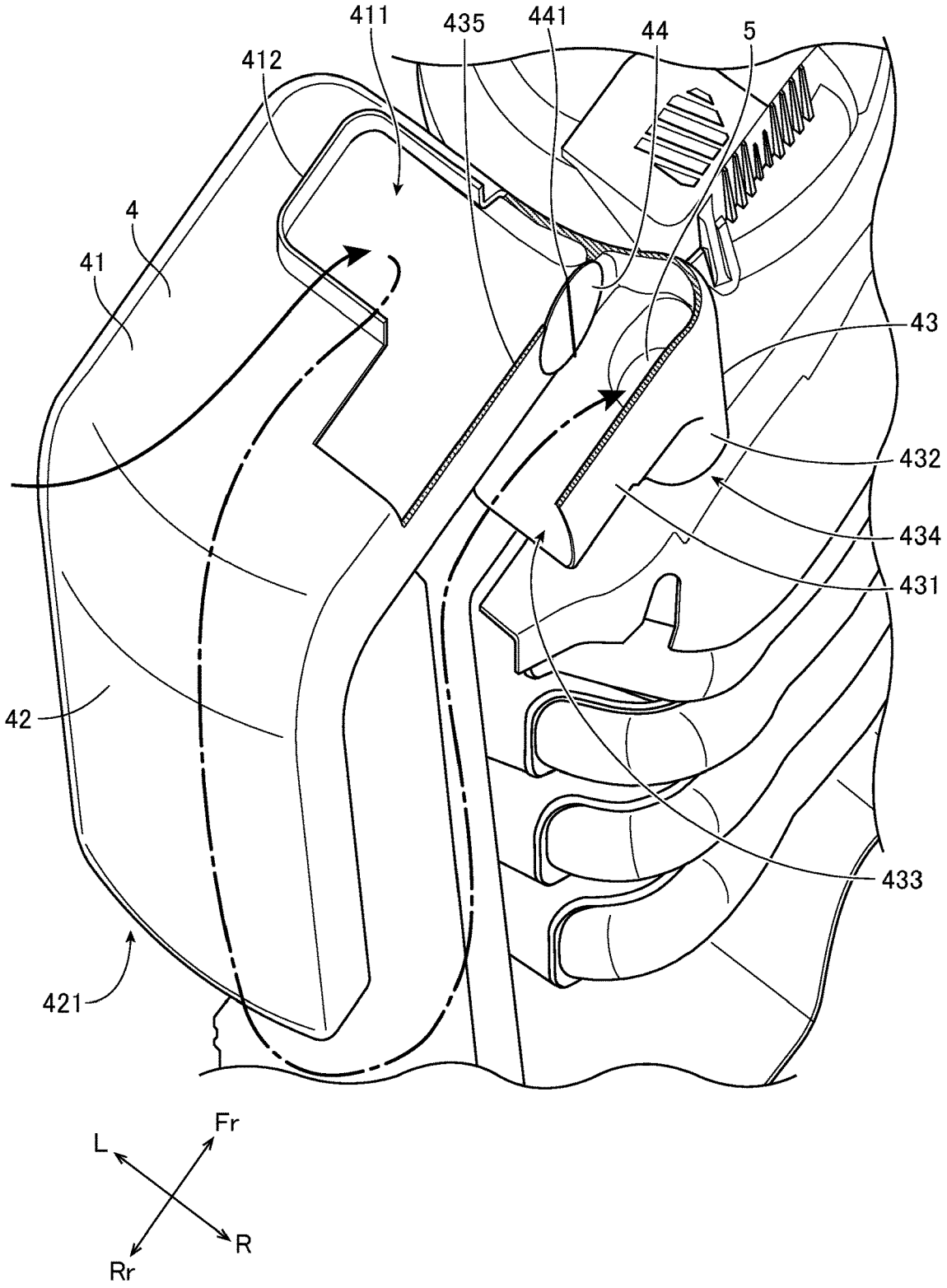
FIG. 3 is a perspective view of the intake duct and a periphery of the intake duct included by the outboard engine according to the present embodiment.
Figure 4:
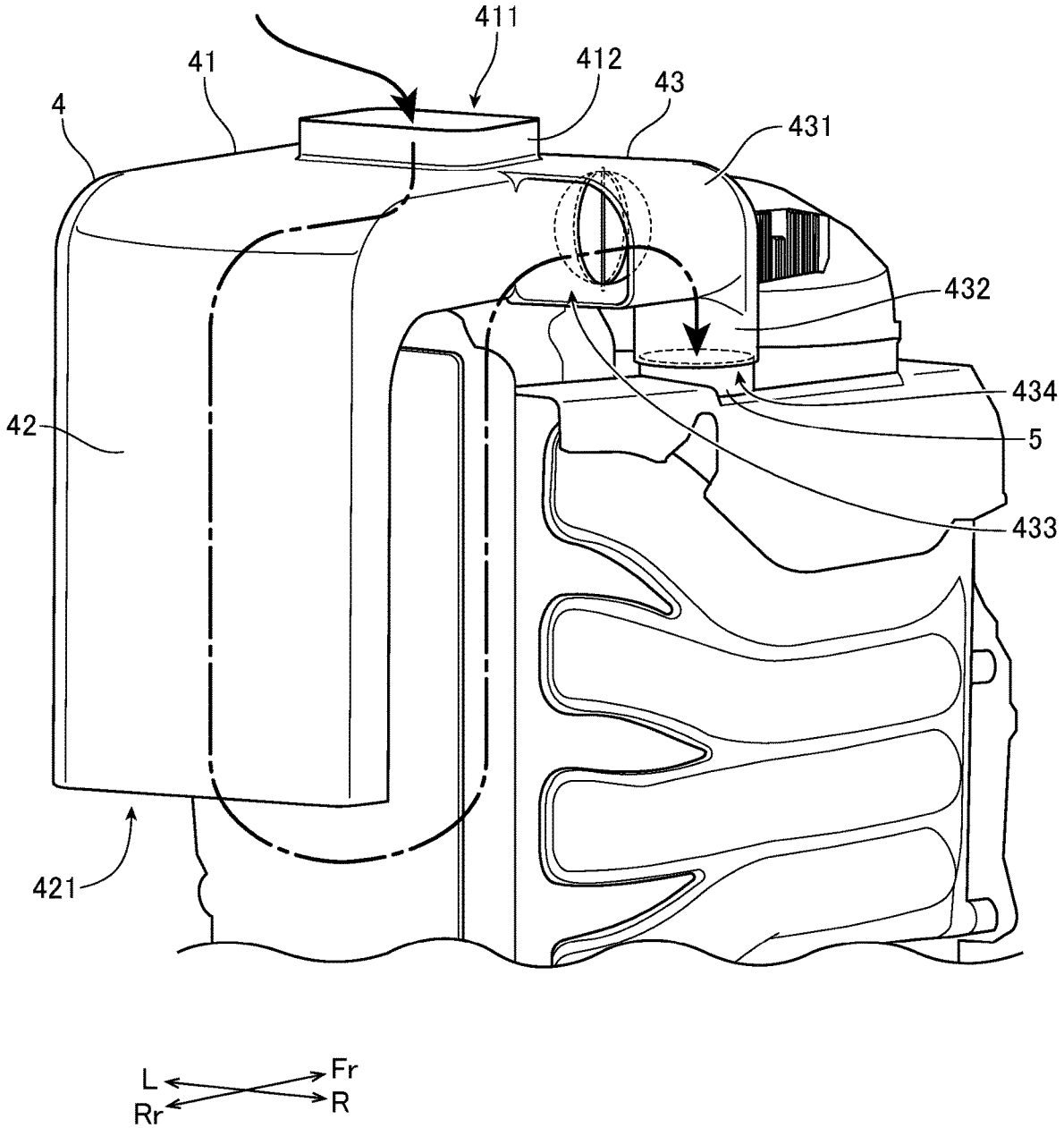
FIG. 4 is a perspective view of the intake duct and the periphery of the intake duct included by the outboard engine according to the present embodiment.
Figure 5:
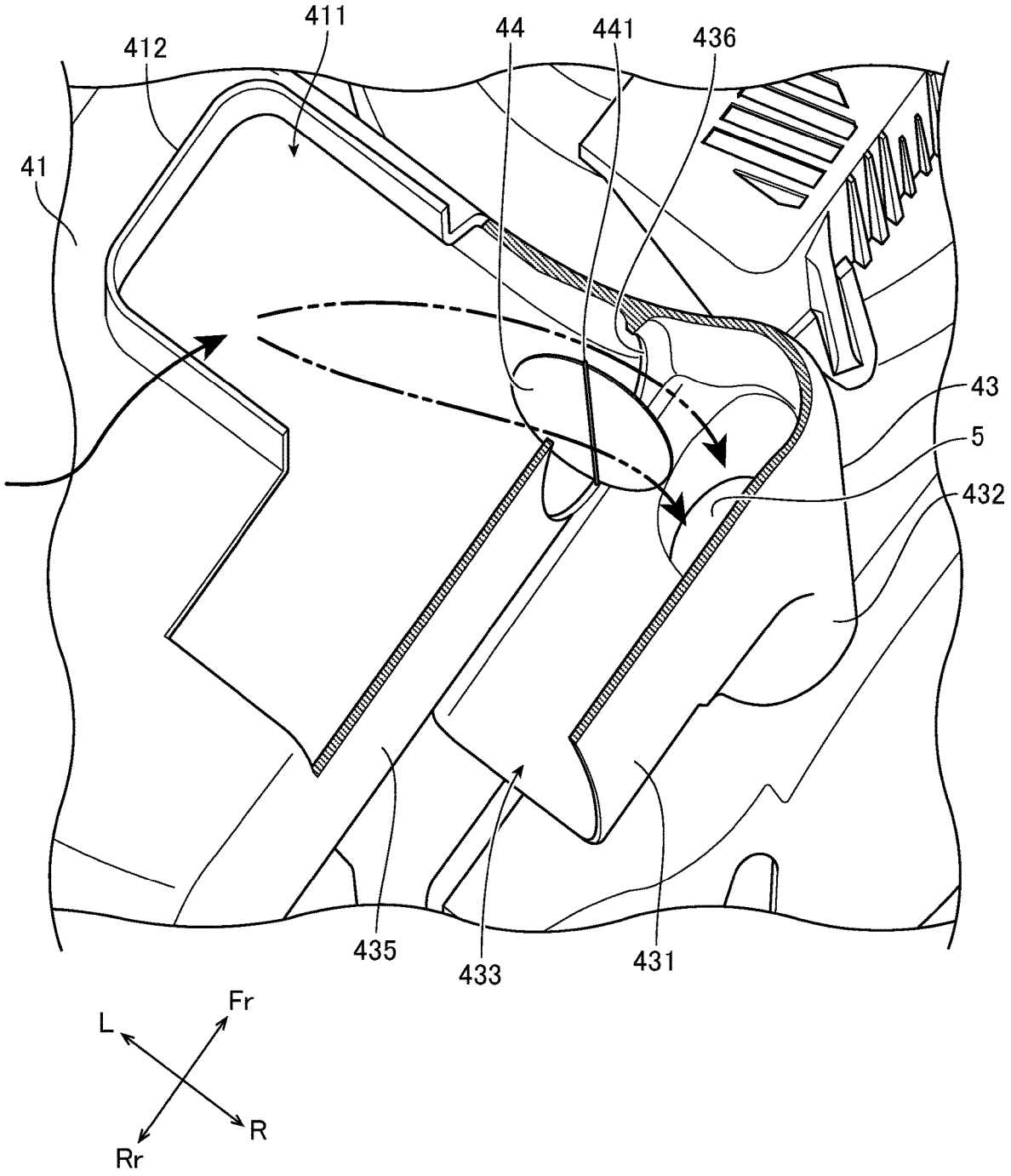
FIG. 5 is a perspective view of the intake duct and the periphery of the intake duct included by the outboard engine according to the present embodiment.
Figure 6:
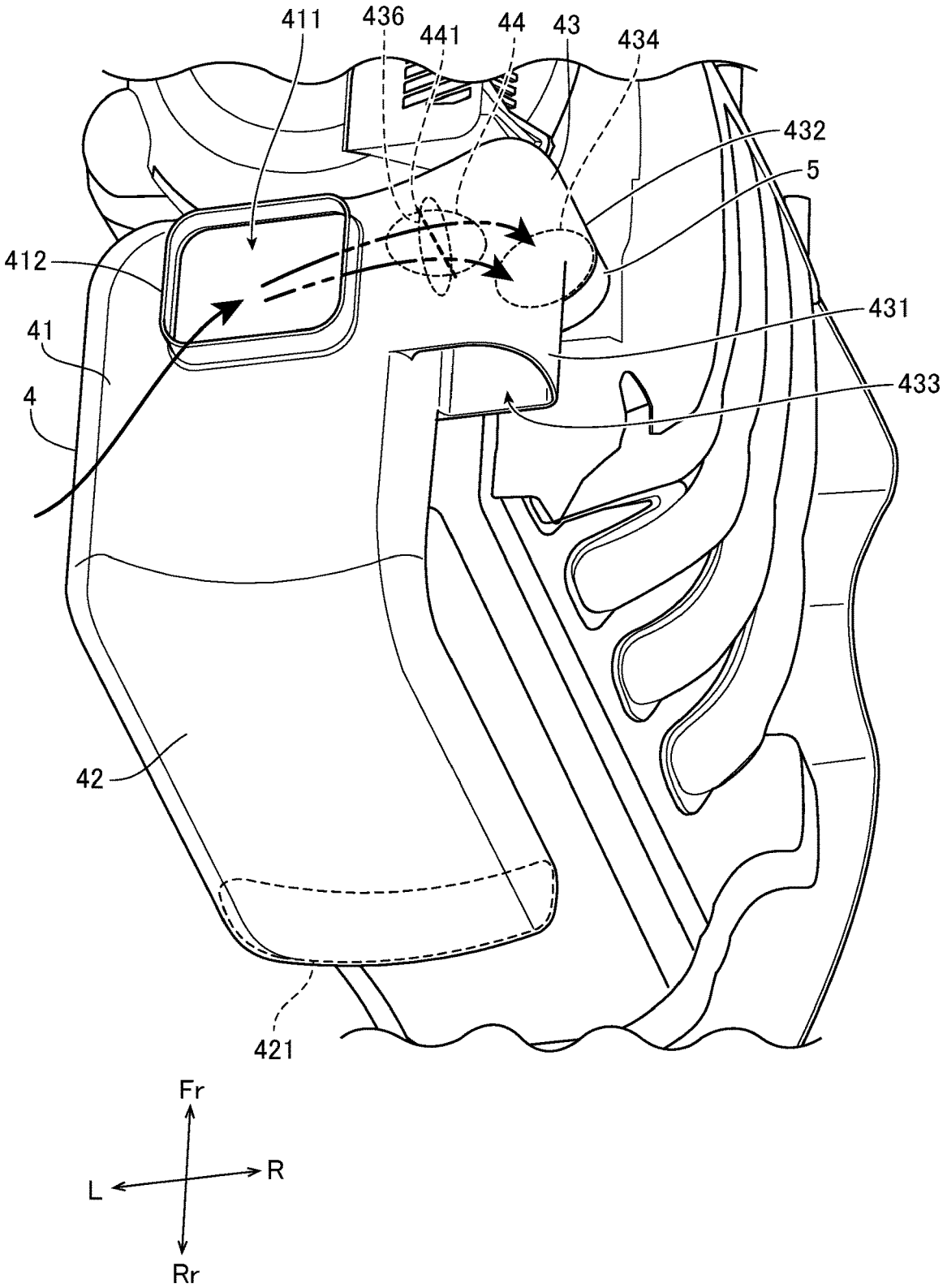
FIG. 6 is a perspective view of the intake duct and the periphery of the intake duct included by the outboard engine according to the present embodiment.

FIG. 3 to FIG. 6 are perspective views of the intake duct 4 and a periphery of the intake duct 4 included by the outboard engine 1 according to the present embodiment. FIG. 3 and FIG. 4 each illustrates the first intake passage with a relatively long flow distance of air of the pair of intake passages, and FIG. 5 and FIG. 6 illustrates the second intake passage with a relatively short flow distance of air of the pair of intake passages. Note that in FIG. 3 to FIG. 6, an engine cover 3 included by the outboard engine 1 is omitted for convenience of explanation. Hereinafter, for convenience of explanation, a front and a rear of the outboard engine 1 are respectively indicated by an arrow Fr and an arrow Rr, and a left and a right of the outboard engine 1 are respectively indicated by an arrow L and an arrow R.

As illustrated in FIG. 2, the outboard engine 1 includes the engine cover 3 that covers the engine body 2. The engine body 2 is configured by a water-cooled four-cycle four-cylinder engine in which, for example, a cylinder head, a cylinder block, a crankcase and the like are combined though details of the respective components are not illustrated, and a crankshaft is arranged substantially vertically. A drive shaft is connected to a lower end of the crankshaft, and a bevel gear and a propeller shaft are connected to a lower end of the drive shaft. A drive force of the engine body 2 is configured to be transmitted to a propeller via the crankshaft, the drive shaft, the bevel gear and the propeller shaft, and generate a propulsive force.

An outside air introduction port 31 is formed in an upper part at a rear side of the engine cover 3. The outside air introduction port 31 is a portion for taking in combustion air required for drive of the engine body 2. The combustion air is taken into the engine cover 3 from outside of the engine cover 3 via the outside air introduction port 31. The intake duct 4 is provided in a part at an upper side of the engine body 2 and a rear side of the engine body 2 (see FIG. 3 to FIG. 6). The intake duct 4 has a hollow shape, and functions as an intake air guide portion that guides the combustion air that is taken in from the outside air introduction port 31.

As illustrated in FIG. 3 to FIG. 6, the intake duct 4 is configured by including a horizontal shape portion (hereinafter, referred to as a "horizontal portion") 41, a hanging shape portion (hereinafter, referred to as a "hanging portion") 42 and a cylindrical portion 43. The horizontal portion 41 is disposed to extend in a horizontal direction at a side above the engine body 2. The hanging portion 42 is connected to a rear end portion of the horizontal portion 41. The hanging portion 42 is connected to a rear end portion of the horizontal portion 41. The hanging portion 42 is disposed to extend in an up-down direction at a rear side of the engine body 2. The cylindrical portion 43 is provided to connect to a part at a right side of the horizontal portion 41. Note that in FIG. 3 and FIG. 5, a part of a top surface of the horizontal portion 41 and a part of a top surface of the cylindrical portion 43 are omitted for convenience of explanation. Further, in FIG. 4 and FIG. 6, some of components in the intake duct 4 are shown by broken lines.

In the horizontal portion 41, an opening portion 411 is formed in a part of the top surface on a front side (see FIG. 4 and FIG. 6). The opening portion 411 is disposed in a vicinity of a front end portion of the top surface of the horizontal portion 41. A wall portion 412 extending to an upper side is provided around the opening portion 411. The opening portion 411 is disposed to face a space at a front side of the outside air introduction port 31, in the engine cover 3 (see FIG. 2). A lower end portion of the hanging portion 42 extends to a vicinity of a lower end portion of the engine body 2. An opening portion 421 opened to a lower side is formed in the lower end portion of the hanging portion 42. The opening portion 421 is formed in the entire lower end portion of the hanging portion 42, but is not limited to this. A single or a plurality of opening portions 421 may be formed in a part of the hanging portion 42.

The cylindrical portion 43 is provided at a part of the front side of the horizontal portion 41. As illustrated in FIG. 4 and FIG. 6, the cylindrical portion 43 has a first cylindrical portion 431 extending in a front-back direction, and a second cylindrical portion 432 connected to a front end portion of the first cylindrical portion 431 and extending in the up-down direction. An opening portion 433 that opens to a rear side is formed in a rear end portion of the first cylindrical portion 431. An opening portion 434 that opens to a lower side is formed in a lower end portion of the second cylindrical portion 432. The opening portion 434 is connected to an intake pipe of a throttle body 5 provided in the engine body 2. The throttle body 5 plays a role of feeding air (combustion air) taken in from the outside air introduction port 31 into the engine body 2.

As illustrated in FIG. 3 and FIG. 5, a wall portion 435 on a left side of the cylindrical portion 43 (first cylindrical portion 431) also serves as a part of a wall portion on a right side of the horizontal portion 41. In a vicinity of a front end portion of the wall portion 435, an opening portion 436 is formed (see FIG. 5). The opening portion 436 has a generally circular shape. The opening portion 436 is configured to be able to allow a space in the horizontal portion 41 and a space in the cylindrical portion 43 (first cylindrical portion 431) to communicate with each other.

In the opening portion 436, an on-off valve 44 is disposed. The on-off valve 44 configures one example of a switch valve that is disposed partway in the intake duct 4. The on-off valve 44 has a generally disk shape. An outer shape dimension of the on-off valve 44 is configured to be slightly smaller than an inside diameter dimension of the opening portion 436. The on-off valve 44 is configured to be able to open and close the opening portion 436. The on-off valve 44 is provided with a shaft portion 441 that penetrates a center of the on-off valve 44 in the up-down direction. Both end portions (upper and lower end portions) of the shaft portion 441 are axially supported rotatably by a top surface and an undersurface of the horizontal portion 41.

The on-off valve 44 opens and closes the opening portion 436 by rotating (swinging) within a fixed range around the shaft portion 441 based on an output from the aforementioned switching device 80. FIG. 3 illustrates a state where the on-off valve 44 closes the opening portion 436, and FIG. 5 illustrates a state where the on-off valve 44 opens the opening portion 436. As illustrated in FIG. 3 and FIG. 5, for example, the on-off valve 44 can close the opening portion 436 by being located parallel with the wall portion 435, and can open the opening portion 436 by being located perpendicularly to the wall portion 435.

In the present embodiment, the switching device 80 that drives the on-off valve 44 is disposed on an engine body 2 side (see FIG. 2). By disposing the switching device 80 on the engine body 2 side, wiring for the switching device 80 and waterproofing for the switching device 80 are facilitated. Note that the switching device 80 may be disposed on an engine cover 3 side (for example, an inner wall surface of the engine cover 3). However, in this case, attaching and detaching or the like of wiring is required in maintenance or the like of the outboard engine 1, or a weight of the engine cover 3 itself increases. Therefore, from the viewpoint of working efficiency, it is preferable to dispose the switching device 80 on the engine body 2 side.

In the outboard engine 1 according to the present embodiment, the intake passage in the intake duct 4 is switched by switching the opening and closing state of the on-off valve 44. The intake passage of the outboard engine 1 can be switched between the first intake passage formed in the outboard engine 1 by closing the on-off valve 44, and the second intake passage formed in the outboard engine 1 by opening the on-off valve 44. Hereinafter, the first and the second intake passages formed in the outboard engine 1 according to the present embodiment will be described with reference to FIG. 2 to FIG. 6. Note that in FIG. 2 to FIG. 6, air flowing through the first intake passage is shown by an alternate long and short dash line, air flowing through the second intake passage is shown by an alternate long and two short dashes line, and air flowing through the first and the second intake passages in common is shown by a solid line.

First, the first intake passage will be described. As illustrated in FIG. 2, air (combustion air) that is introduced into the engine cover 3 from the outside air introduction port 31 enters an inside of the intake duct 4 (horizontal portion 41) from the opening portion 411 of the horizontal portion 41. As illustrated in FIG. 3 and FIG. 4, when the on-off valve 44 is closed, the air entering the horizontal portion 41 flows to the rear side in the horizontal portion 41, and moves to the hanging portion 42. Subsequently, after flowing in the hanging portion 42, the air is released into the engine cover 3 from the opening portion 421. Subsequently, the air enters the first cylindrical portion 431 from the opening portion 433 after flowing around the engine body 2, and is fed into an intake pipe of the throttle body 5 via the second cylindrical portion 432.

The air released into the engine cover 3 from the opening portion 421 flows toward the cylindrical portion 43 while cooling electrical components (ignition coil and the like) not illustrated that are attached to the engine body 2 and disposed partway in a flow of the air. Subsequently, the air is fed into the throttle body 5 after flowing into the cylindrical portion 43 while cooling the electrical components and the like. Consequently, the air is fed to the engine body 2 in a state where the air is warmed more than when introduced from the outside air introduction port 31.

When the air introduced from the outside air introduction port 31 includes water (water drops and splashes), the water is dropped to a lower side when air is released from the opening portion 421. The water is drained to outside from a drainage port not illustrated provided in the outboard engine 1. Consequently, the water included in the air introduced from the outside air introduction port 31 can be prevented from entering the engine body 2 via the throttle body 5.

Next, the second intake passage will be described. As illustrated in FIG. 5 and FIG. 6, when the on-off valve 44 is opened, the air entering the horizontal portion 41 passes through the opening portion 436 and moves into the cylindrical portion 43 (first cylindrical portion 431) without flowing to the rear side in the horizontal portion 41. Subsequently, the air entering the first cylindrical portion 431 is fed into the throttle body 5 via the second cylindrical portion 432. In this case, the air flows into the cylindrical portion 43 without flowing in the rear side portion of the horizontal portion 41 and the hanging portion 42. Consequently, the air is fed into the engine body 2 in a state where the air almost maintains a temperature at a time of being introduced from the outside air introduction port 31.

The first intake passage is configured by the horizontal portion 41, the hanging portion 42, a part of a space in the engine cover 3 and the cylindrical portion 43, and therefore, configures a path (long path) with a long air flow distance. Further, since the first intake passage has the hanging portion 42 in a part of the passage, and has a configuration in which the air flow path is reversed, the first intake passage has an effect of draining water that enters the intake duct 4 (draining effect). Furthermore, the first intake passage has the long air flow distance, and therefore includes an effect of reducing an air intake noise using air column resonance or the like (silence effect).

The second intake passage is configured by the horizontal portion 41 and the cylindrical portion 43, and therefore configures a path (short path) with a short air flow distance. The second intake passage is connected to the throttle body 5 via the horizontal portion 41 and the cylindrical portion 43, and therefore, does not include a drainage effect to the water entering the intake duct 4. On the other hand, the second intake passage has a short air flow distance, and therefore has an advantage of being able to supply air into the engine body 2 while almost keeping a temperature (outside air temperature) of air introduced into the engine cover 3. This enhances output of the engine body 2 as compared with a case where combustion air is supplied to the engine body 2 via the first intake passage.

As described above, in the outboard engine 1 according to the present embodiment, the first intake passage and the second intake passage are switched in response to a predetermined condition. For example, in the outboard engine 1, the intake passage is switched according to water (water drops) entering the engine cover 3. Therefore, the water detectors 62 are provided in predetermined positions in the engine cover 3. For example, the water detectors 62 are disposed in a vicinity of the outside air introduction port 31. More specifically, the water detector 62 is provided in a vicinity of a rear end portion of the top surface of the horizontal portion 41 of the intake duct 4, a position facing the horizontal portion 41, of an inner wall surface of the engine cover 3, and a position corresponding to the on-off valve 44 of an undersurface of the cylindrical portion 43 (see FIG. 2). By disposing the water detectors 62 in the vicinity of the outside air introduction port 31 in this way, the water entering from the outside air introduction port 31 can be detected with high precision.

Here, the switching conditions of the intake passage of the outboard engine 1 according to the present embodiment will be described with reference to FIG. 7. FIG. 7 is an explanatory diagram of a switching condition table 700 of the intake passages of the outboard engine 1 according to the present embodiment. In the switching condition table 700 shown in FIG. 7, the intake passages (first and second intake passages) that are selected according to various switching conditions are specified. The operation unit 52 of the control device 50 switches the intake passage according to information inputted from various devices and registered contents of the switching condition table 700. The switching condition table 700 illustrated in FIG. 7 is recorded in the ROM of the operation unit 52, for example.

Note that the outboard engine 1 according to the present embodiment is configured to select the first intake passage (long path) by closing the on-off valve 44 in a steady state, and select the second intake passage (short path) by opening the on-off valve 44 in a case where the engine body 2 needs to output a certain amount of power or more, or the like. Further, the outboard engine 1 according to the present embodiment is configured to select the first intake passage (long path) at a time of the engine body 2 being stopped or at a time of an operation state in which the outboard engine 1 is expected to be covered with water. For example, the time of the operation state where the outboard engine 1 is expected to be covered with water includes a time of deceleration from forward movement, a time of shift change to neutral, or a time of backward movement.

As illustrated in FIG. 7, the first intake passage is selected at the time of the engine body 2 being stopped (Switching condition #1). Likewise, when the shift is set to neutral or reverse (backward movement), the first intake passage is selected (Switching conditions #2 and #3). This is because the outboard engine 1 is expected to be covered with a large amount of water in these cases. Further, when the throttle opening degree and the engine speed are less than specified values, the first intake passage is selected (Switching conditions #6 and #7). This is because it is considered that the engine body 2 does not need to output a predetermined amount of power or more in these cases.

Further, when a temperature in the engine cover 3, and a temperature of a ventilation unit or the electrical components are a predetermined value or more, the first intake passage is selected (Switching conditions #8 to #10). This is to cool the electrical components and the like to prevent occurrence of failure or malfunction of the electrical components and the like following increase in temperature, in these cases. When a water drop is detected in the engine cover 3, the first intake passage is selected (Switching condition #11). This is to prevent occurrence of failure and malfunction of the engine body 2, the electrical components and the like following entry of the water drop into the engine body 2, in this case.

When the first intake passage is selected by the setting switch 74, the first intake passage is selected (Switch condition #12). However, even when the first intake passage is selected by the setting switch 74, the second intake passage is selected when the throttle opening degree is a specified value or more as will be described later. In this case, it is possible to select the intake passage suitable for the operation state of the outboard engine 1 by prioritizing the detection information of the actual device over setting by the operator.

When the shift is set to forward (forward movement), the second intake passage is selected (Switching condition #4). Further, when the throttle opening degree is a specified value or more, the second intake passage is selected (Switching condition #5). This is to prioritize enhancement of output of the engine body 2 over the water drainage effect and the cooling effect for the electrical components and the like in these cases. However, when deceleration from forward movement is expected even when the shift is forward, the first intake passage is maintained without being switched to the second intake passage. Further, when the shift is set to neutral and reverse (backward movement) and the engine body 2 is stopped even when the throttle opening degree is the specified value or more, the first intake passage is maintained without being switched to the second intake passage. This is because the outboard engine 1 is expected to be covered with a large amount of water in these cases.

Here, the reason why the first intake passage is selected when the shift is set to reverse will be described with reference to FIG. 8. FIG. 8 is an explanatory view of a water covering state at the time of backward movement of a ship including the outboard engine 1 according to the present embodiment. As illustrated in FIG. 8, when a ship 100 including the outboard engine 1 moves backward on the sea and the like, waves hit a rear surface of the outboard engine 1 and may rise, and fall. In this case, depending on a state of a sea surface (waves, swells), the shape of the hull, the backward moving speed, and the like, the outboard engine 1 may be covered with a large amount of water, and seawater and the like easily enter through the outside air introduction port 31. Consequently, in the switching condition table illustrated in FIG. 7, it is registered that the first intake passage is selected when the shift is set to reverse.

Figure 9:
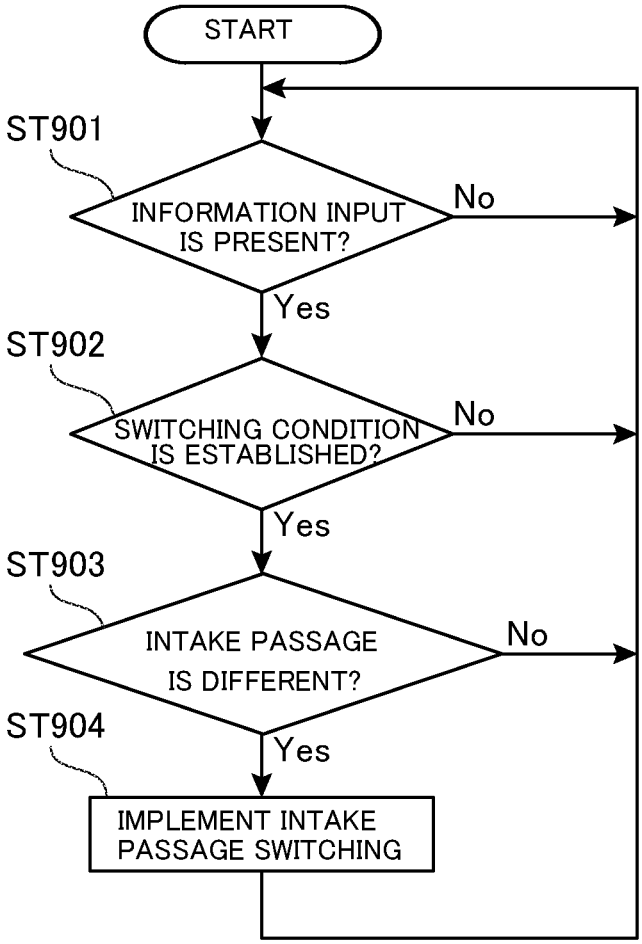
FIG. 9 is a flowchart at a time of switching the intake passage of the outboard engine according to the present embodiment.

Hereinafter, an operation at a time of switching the intake passage in the outboard engine 1 according to the present embodiment will be described with reference to FIG. 9. FIG. 9 is a flowchart at a time of switching the intake passage of the outboard engine 1 according to the present embodiment. An operation flow illustrated in FIG. 9 is started by the control device 50 (operation unit 52) by the operator bringing an ignition key into an on state. Since the engine body 2 is in a stopped state until the ignition key is brought into the on state, the on-off valve 44 is closed and the first intake passage is selected (see Switching condition #1).

In step (ST) 901, the operation unit 52 determines input of various kinds of information from various devices inside and outside the outboard engine 1. For example, the operation unit 52 determines input of water detection signals from the water detectors 62. Here, when there is no input of the information from the various devices (ST901: No), the operation unit 52 repeats determination in ST901. When there is an input of the information from the various devices (ST901: Yes), the operation unit 52 advances a process to ST902.

In ST902, the operation unit 52 determines whether the switching condition is established based on the information inputted in ST901. When the switching condition is not established here (ST902: No), the operation unit 52 returns the process to ST901, and performs determination in ST901 again. When the switching condition is established (ST902: Yes), the operation unit 52 advances the process to ST903.

In ST903, the operation unit 52 determines whether the intake passage (the first or the second intake passage) corresponding to the established switching condition differs from a present intake passage. When the corresponding intake passage is same as the present intake passage (ST903: No), the operation unit 52 returns the process and performs determination in ST901 again. When the corresponding intake passage differs from the present intake passage (ST903: Yes), the operation unit 52 advances the process to ST904.

In ST904, the operation unit 52 switches the intake passage via the switching device 80. For example, when the intake passage corresponding to the switching condition established in ST902 is the second intake passage, from the steady state (first intake passage), the operation unit 52 opens the on-off valve 44, and switches the intake passage to the second intake passage. After the intake passage is switched in ST904, the operation unit 52 returns the process, and performs determination in ST901 again. The flow illustrated in FIG. 9 is performed continuously while the outboard engine 1 is in the on state.

As described above, in the outboard engine 1 according to the present embodiment, the plurality of intake passages are provided in the intake duct 4, the intake passage of the intake duct 4 is made switchable to the first intake passage (long path) including the drainage effect, and the second intake passage (short path) without including the drainage effect by the on-off valve 44, and the first intake passage is selected at the time of the engine body 2 being stopped or at the time of the operation state where the outboard engine 1 is expected to be covered with water. Thereby, even when the outboard engine 1 is covered with water, the water entering the intake duct 4 can be drained, so that a situation where water enters the engine body 2 can be restrained, and performance of the engine body 2 can be secured. Further, since the situation where water enters the engine body 2 can be prevented, damage or corrosion of the components in the engine body 2 can be restrained. As a result, even under the environment where the outboard engine 1 is covered with water, performance of the engine body 2 can be secured and occurrence of malfunction of the engine components can be restrained.

Further, since the water entering the intake duct 4 is also drained even at the time of the engine body 2 being stopped, it is also possible to prevent the situation where water enters the engine body 2 during maintenance of the outboard engine 1, and natural disasters (covered with a large amount of water) during mooring, for example. Thereby, damage or corrosion of the components in the engine body 2 can be restrained, and therefore durability of the outboard engine 1 can be secured.

Further, the outboard engine 1 according to the present embodiment is configured such that the water detectors 62 that detect water (water drops, splashes) are disposed in the vicinity of the outside air introduction port 31, and when water is detected by the water detector 62, the first intake passage is selected (FIG. 7: Switching condition #11). Thereby, the water entering from the outside air introduction port 31 is detected quickly, and the first intake passage can be selected as the intake passage in the intake duct 4. As a result, even when a water drop enters the engine cover 3, the situation where a large amount of water enters the engine body 2 can be prevented.

Furthermore, the outboard engine 1 according to the present embodiment is configured to select the first intake passage at the time of deceleration from forward movement, the time of shift change to neutral, the time of backward movement, or the like (FIG. 7: Switching conditions #6, #7, #2, #3). Thereby, in the situation where the outboard engine 1 is expected to be covered with a large amount of water, the first intake passage can be reliably selected, and the situation where a large amount of water enters the engine body 2 can be prevented.

Furthermore, the outboard engine 1 according to the present embodiment is configured to select the first intake passage when the detection temperatures of the temperature detectors 60 that detect an internal temperature of the engine cover 3 and the like exceed a predetermined temperature (FIG. 7: Switching conditions #8 to #10). Since the first intake passage has a longer air flow distance as compared with the second intake passage (short path), the electrical components and the like provided in the engine body 2 can be cooled in the flow process of air, and therefore durability of the electrical components and the like can be improved.

Furthermore, in the outboard engine 1 according to the present embodiment, the intake passage in the intake duct 4 is made selectable by the setting switch 74. The outboard engine 1 is configured such that when the operation unit 52 of the control device 50 determines switching to the first intake passage in response to the input information from various devices even when the second intake passage is selected by the setting switch 74, the determination is prioritized, and the intake passage is switched to the first intake passage (exception of Switching condition #13 illustrated in FIG. 7). This can prevent the engine body 2 from being damaged due to erroneous selection of the intake passage or the like by the operator.

Furthermore, in the outboard engine 1 according to the present embodiment, the first intake passage has the path that temporarily guides the air from the outside air introduction port 31 to a lower part in the engine cover 3 and thereafter feeds the air to the throttle body 5. On the other hand, the second intake passage has the path that passes the air from the outside air introduction port 31 to above the engine body 2 and feeds the air to the throttle body 5. Thereby, when the first intake passage is selected, the water included in the air can be separated in the air flow process. On the other hand, when the second intake passage is selected, fresh air (cool air) that is introduced from the outside air introduction port 31 can be directly supplied into the engine body 2, and therefore output of the engine body 2 can be enhanced.

Furthermore, in the outboard engine 1 according to the present embodiment, the second intake passage is the path for combustion air that enables output exceeding maximum output of the engine body 2 in the first intake passage. Thereby, it is possible to make the utmost use of the engine performance of the outboard engine 1 by selecting the second intake passage except for the time of the operation state where the outboard engine 1 is expected to be covered with water or the like.

Note that the present invention can be carried out by being variously changed without being limited to the above described embodiment. In the above described embodiment, it is possible to properly change the dimensions, shapes and the like illustrated in the accompanying drawings within the range in which the effect of the present invention is exhibited without being limited to the dimensions, shapes and the like illustrated in the accompanying drawings. In addition, it is possible to carry out the present invention by properly changing the present invention within the range without departing from the object of the present invention.

Figure 10:
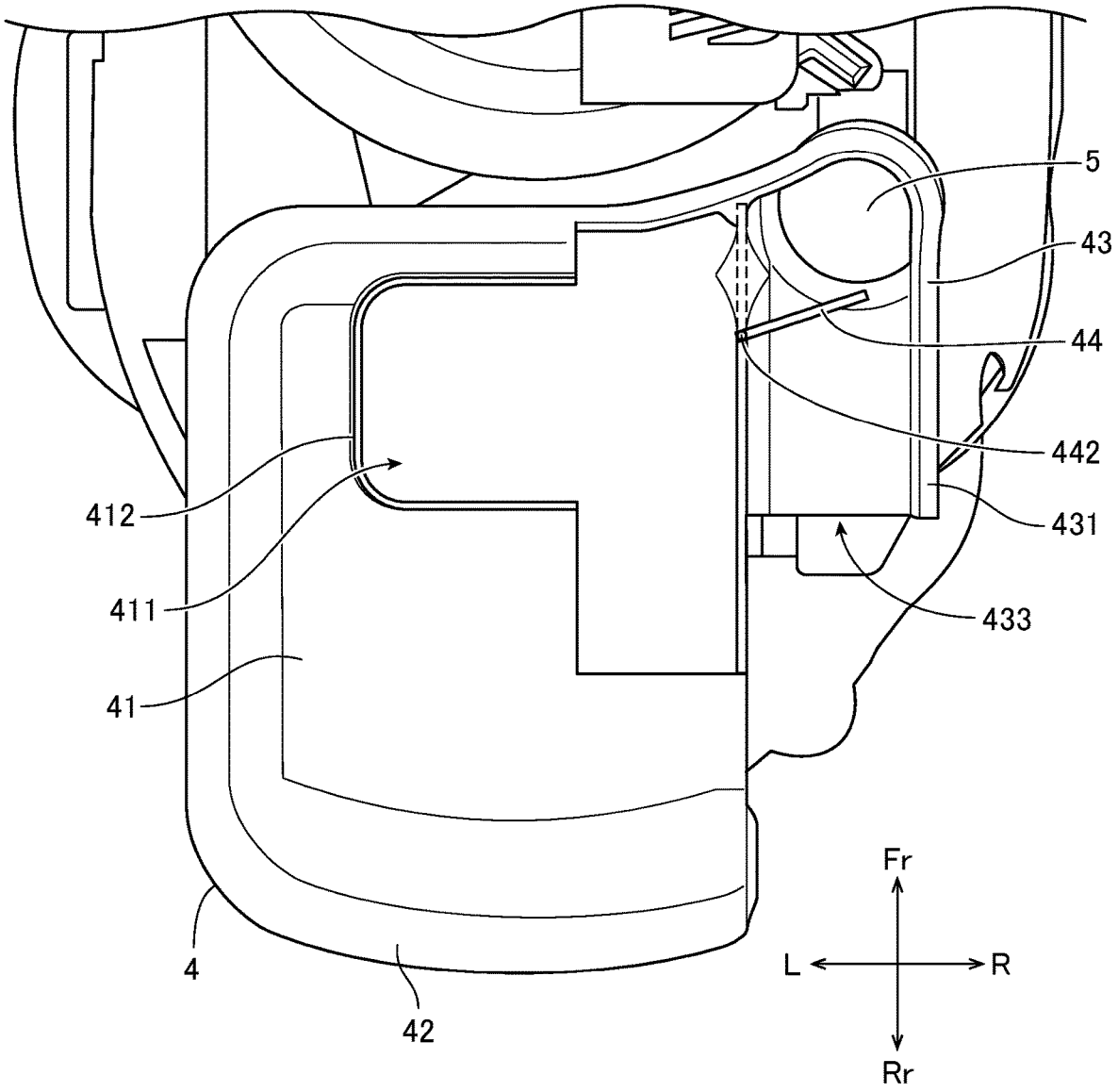
FIG. 10 is an explanatory view of an intake passage of an outboard engine according to a modification of the present embodiment.

For example, the above described embodiment adopts the configuration in which the shaft portion 441 that passes through the center of the on-off valve 44 in the up-down direction is provided. However, the configuration of the on-off valve 44 is not limited to this, and can be properly changed. For example, as illustrated in FIG. 10, a configuration may be adopted, in which a shaft portion 442 is provided at a rear end portion of the on-off valve 44, and a front side portion from the shaft portion 442 in the on-off valve 44 is opened and closed to a right side. Note that in FIG. 10, a state where the on-off valve 44 is opened is shown by a solid line, and a closed state is shown by a broken line. It is also possible to obtain a similar effect to the effect of the above described embodiment even when the on-off valve 44 is configured like this.

REFERENCE SIGNS LIST

1: outboard engine
2: engine body
3: engine cover
31: outside air introduction port
44: on-off valve
4: intake duct
5: throttle body
50: control device
80: intake passage switching device (switching device)

What is claimed is:

1. An outboard engine, comprising:
an outside air introduction port that is provided in an engine cover covering an engine body and takes in combustion air;
a throttle body that feeds the combustion air that is taken in from the outside air introduction port, into the engine body;
an intake air guide portion that guides the combustion air from the outside air introduction port;
a switching valve disposed partway in the intake air guide portion;
an actuator that drives the switching valve; and
a control device that controls movement of the actuator,
wherein the actuator is disposed at an upper portion of the engine body, a plurality of paths are provided in the intake air guide portion, a path of the intake air guide portion is made switchable to a long path including a drainage effect to water entering the intake air guide portion and a short path that does not include the drainage effect by the switching valve, and the long path is selected at a time of an engine of the outboard engine being stopped or a time of an operation state where the outboard engine is expected to be covered with water.

2. The outboard engine according to claim 1, wherein a water detection sensor that detects water is disposed in a vicinity of the outside air introduction port, and when water is detected by the water detection sensor, the long path is selected.

3. The outboard engine according to claim 1, wherein the time of the operation state where the outboard engine is expected to be covered with water includes a time of deceleration from forward movement, a time of shift change to neutral, or a time of backward movement.

4. The outboard engine according to claim 1, wherein a temperature detection unit that detects a temperature of the engine body and/or an inside of the engine cover is provided at the engine body, and when a detection temperature of the temperature detection unit exceeds a predetermined temperature, the long path is selected.

5. The outboard engine according to claim 1, wherein the long path and the short path are made selectable manually, and when the control device determines switching to the long path, the determination of the control device is prioritized.

* * * * *